United States Patent [19]

Ou-Yang

[11] Patent Number: 4,935,273

[45] Date of Patent: Jun. 19, 1990

[54] PRESSURE-ACTIVATED INNERSEALS AND CONTAINERS USING SAME

[75] Inventor: David T. Ou-Yang, Woodbury, Minn.

[73] Assignee: Minnesota Mining and Manufacturing Company, St. Paul, Minn.

[21] Appl. No.: 305,476

[22] Filed: Feb. 1, 1989

[51] Int. Cl.[5] ..... B65D 53/04; C09J 7/02

[52] U.S. Cl. ..... 428/35.7; 215/347; 215/349; 428/36.92; 428/354; 428/355; 428/514; 428/521; 428/522

[58] Field of Search ..... 215/347, 349; 428/35.7, 428/36.92, 343, 354, 355, 514, 519, 521, 522; 526/338

[56] References Cited

U.S. PATENT DOCUMENTS

| | | | |
|---|---|---|---|
| 3,767,608 | 10/1973 | Hand | 260/28.5 R |
| 3,924,748 | 12/1975 | Braverman | 206/534.1 |
| 4,248,917 | 2/1981 | Hornibrook et al. | 428/40 |
| 4,539,248 | 9/1985 | Brockington et al. | 428/354 |
| 4,576,297 | 3/1986 | Larson | 215/347 |
| 4,581,281 | 4/1986 | Gerace | 428/355 |
| 4,626,460 | 12/1986 | Dunian | 428/354 |
| 4,807,772 | 2/1989 | Schloss | 215/349 |
| 4,818,577 | 4/1989 | Ou-Yang | 428/36.5 |

OTHER PUBLICATIONS

Safe-Gard TM Innerseals, prior to Feb. 1, 1989.

*Primary Examiner*—James Seidleck
*Attorney, Agent, or Firm*—Donald M. Sell; Walter N. Kirn; David L. Weinstein

[57] ABSTRACT

Closure liner, i.e., innerseal, comprising a pressure-activated adhesive that is a copolymer of butadiene and acrylonitrile or methacrylonitrile. The copolymer has a single glass transition temperature of no higher than about −25° C., a nitrile content of no greater than about 31% by weight, preferably of from about 18% by weight to about 30% by weight, a Mooney viscosity of at least 95 (measured according to ASTM D1646-87 at 100° C. for 4 minutes), preferably from about 120 to about 150. The copolymer is not cross-linked, and the amount of vinyl groups in the copolymer should not exceed 10% by weight.

17 Claims, 1 Drawing Sheet

PRESSURE-ACTIVATED INNERSEALS AND CONTAINERS USING SAME

FIELD OF THE INVENTION

The present invention relates to closure liners, i.e., innerseals, using pressureactivated adhesives. More particularly, it relates to pressure-activated innerseals.

BACKGROUND ART

Innerseals are widely used throughout the packaging industry to cover the opening of a container and to provide a seal between the container and the cap. Generally, two types of innerseals are used. The first consists of a dimensionally stable substrate which may be placed over the opening of the container It is held in place only by the compressive forces between the container and the cap. As this type of innerseal is not adhered to the container, it does not protect against leaks and spills.

The second general type of innerseal utilizes an adhesive composition on one surface of a dimensionally stable substrate. The adhesive compositions employed most commonly are either pressure-sensitive compositions or heat-activated compositions While both of these compositions have been used to adhere innerseals to container openings, they both suffer from certain disadvantages.

Innerseals that employ pressure-sensitive adhesive layers commonly require the use of release liners to prevent the innerseal from adhering to itself prior to application to a container. This, in turn, makes handling and applying such innerseals more cumbersome and less efficient, and consequently, more expensive, as the liner must be removed and discarded before the innerseal can be used. Additionally, the liner creates waste which must be handled and discarded. Furthermore, many wet and dry products will adhere to the surface of the pressure-sensitive adhesive, resulting in the innerseals having a poor appearance.

Innerseals that employ heat-activated adhesive layers require the use of special application equipment, thereby adding to the expense of the packaging operation and increasing the opportunity for equipment malfunction. Furthermore, one of the more commonly used heat-activating techniques utilizes high frequency induction sealing. This technique requires the presence of a metal foil layer in the innerseal and, consequently, is useful for only certain types of innerseals.

Innerseal materials that can be adhered to a container by the application of shear forces have also been used. These materials utilize shear-activated adhesives based on block copolymers of styrene-ethylene-butylenestyrene to adhere the innerseal to the container. These materials are not, however, totally satisfactory as the low level of adhesion between the shear-activated adhesive and the lip of the container can be overcome by the pressure built up in the container by all liquid products and some dry products during filling operations, storage, and shipping. Moreover, some shear-activated adhesives cannot be used for fatty food products on account of FDA regulations.

The present invention overcomes the disadvantages of innerseals that utilize pressure-sensitive adhesives, heat-activated adhesives, and shear-activated adhesives. Even though the innerseal of the present invention is pressure-activated, it surprisingly adheres firmly to a container and provides a seal against leaks and spills therefrom even after the cap has been removed. Moreover, it is readily removable from the container. The innerseal of the invention may be applied to containers, portions of containers, laminates, coatings, or any substrate made from a variety of materials having high polarity, including polyvinyl chloride, polyester, polystyrene, polycarbonate, polyvinylidene chloride, and nitrile rubber or its derivatives, such as modified acrylonitrile-methacrylate copolymer.

SUMMARY OF THE INVENTION

In one aspect of the present invention, there is provided a sheet material useful as a pressure-activated innerseal, said sheet material comprising a dimensionally stable substrate bearing a layer of an adhesive composition comprising a butadiene-nitrile random copolymer having a single glass transition temperature of no higher than about −25° C., a nitrile content of no greater than about 31 percent by weight, preferably of from about 18 percent by weight to about 30 percent by weight, and a Mooney viscosity of at least 95, preferably from about 120 to about 150. The copolymer is substantially free of cross-links, and the amount of vinyl groups in the copolymer should not exceed 10% by weight.

In still another aspect of the present invention, there is provided a container which utilizes the aforementioned pressure-activated innerseal.

DETAILED DESCRIPTION

Innerseals utilizing the adhesive composition disclosed herein may be provided in any desired form. Thus, they can be provided in individually designed shapes to cover a particular container opening or they can be provided in bulk either in the form of large sheets or rolls from which a desired shape and size may be subsequently removed.

The substrate to be utilized in the innerseal is dimensionally stable, that is, it neither loses its shape nor undergoes change in dimension under normal use, handling, or storage conditions. The substrate may be compressible or essentially non-compressible and may be rigid or flexible. Additionally, it may have either a single or multiple ply construction. The plies may be of the same or different materials and may have any thickness desired. Typically, the innerseal is from about 1.5 to 65 mil thick.

A wide variety of organic and inorganic materials may be used as a substrate including metal foils such as aluminum or copper foils, cellulosic materials such as paper, pulpboard, glassine and the like, and foamed and non-foamed polymeric films such as polyester, polyvinyl chloride, polyolefin films (e.g., polyethylene and polypropylene), polystyrene, and the like. As noted, the substrate may include several plies. Thus, for example, it may include one or more layers of paper or pulpboard adhered to one or more layers of a metal foil or polymeric film.

The adhesive composition employed on the innerseal utilizes a butadiene-nitrile copolymer rubber. The adhesive composition is pressure-activated, that is, it does not adhere to a surface until it has been pressed, for example, by a force applied. The force for applying the innerseal can be a shear force, e.g., resulting from a twisting action, so long as sufficient pressure is applied so that the adhesive substantially contacts the surface to which it is to be adhered. Once this force is applied to the adhesive composition, the innerseal adheres firmly to the container.

Figure 1:
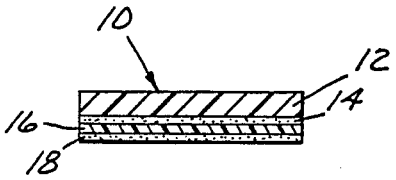
FIG. 1 illustrates in cross-section a sheet material suitable for preparing the innerseal of the present invention.

Referring now to FIG. 1, a typical innerseal 10 utilizing the adhesive of the present invention comprises, from top to bottom, (a) a first film made of paper or polymeric material 12; (b) a layer of thermoplastic or thermosetting adhesive, either plastic-based or rubber-based 14; (c) a second film made of paper or polymeric material 16; (d) a layer of the adhesive composition described herein 18.

The film (a) 12 typically has a thickness ranging from 1 to 50 mil, preferably 2 to 35 mils. Its function is to increase rigidity, compressibility, and improve handling of the innerseal. Materials suitable for film (a) 12 include polyethylene, polypropylene, paper, and laminates of film, paper, or foam of low surface tension, low polarity material. The adhesive of layer (b) 14 can be a thermoplastic adhesive, e.g., pressure-sensitive adhesive, or thermosetting adhesive. The film (c) 16 typically has a thickness ranging from 0.4 to 10 mil, preferably 0.4 to 1 mil. Materials suitable for film (c) 16 include polymers such as polyethylene terephthalate, polyvinylidene chloride, polycarbonate, any of the foregoing polymers coated with adhesive, any of the foregoing polymers vapor coated with metal laminates.

The butadiene-nitrile random copolymers utilized in the adhesive composition for layer 18 are preferably butadiene-acrylonitrile copolymers or butadiene-methacrylonitrile copolymers, i.e., the nitrile moieties are preferably selected from acrylonitrile or methacrylonitrile. In general, a higher nitrile content will provide a higher glass transition temperature ($T_g$). As $T_g$ increases and as nitrile content increases, the copolymer becomes more plastic, less rubbery, more rigid, less compressible, and exhibits poorer wetting ability onto surfaces of high polarity.

The copolymer must have a single $T_g$ and it must be no higher than −25° C. A copolymer having a single $T_g$ is a random copolymer, e.g., it exhibits the repeating structure A-B-B-A-B-A-B-A-A-B. If a copolymer has multiple $T_g$'s, the copolymer is a segmented copolymer, i.e., it exhibits the repeating structure A-A-A-A-B-B-B-B-A-A-A-A-B-B-B-B. If one portion of the molecule has excessive nitrile content, i.e., rigid material, that portion of the copolymer exhibits poor contact and wetting ability to polar surfaces; if the other portion of the molecule has excessive butadiene, that portion of the copolymer exhibits lower polarity and poorer adhesion to polar surfaces.

The Mooney viscosity of the copolymer must be at least 95, preferably about 120 to about 150. As used herein, Mooney viscosity was measured according to ASTM D1646-87 under the following conditions: 100° C., 4 minutes. As Mooney viscosity increases, molecular weight increases. Increased molecular weight gives increased cohesive strength. Increased green strength is desired to minimize cohesive failure, which can be brought about by the pressure built up by the contents of a container during filling operations, storage, and shipping.

The copolymer should have a vinyl content ($CH_2{=}CH{-}$) of less than about 10% by weight. Polymers having a high vinyl content, i.e., greater than 10%, tend to associate when subjected to severe storage conditions, e.g., high temperatures, ultraviolet radiation, heat, oxygen. The vinyl groups in the polymer tend to physically associate, thereby making the molecule superficially larger. This phenomenon restricts the movement of part or all of the molecule, consequently reducing the wetting or degree of contact of the molecule onto a polar surface and reducing the diffusion of part or all of the molecule onto the polar surface, resulting in a reduction of the bond strength between the adhesive and the adherend, e.g., the lip of a container.

The copolymer should be essentially free of cross-links. Cross-linking tends to result in the production of larger molecules, resulting in the molecules insolubility in conventional coating solvents. Chemical bonds formed via cross-linking tend to severely restrict the movement of part or all of the molecule, thereby reducing the wetting of and contact with the polar surface, and consequently reducing hydrogen bonding and diffusion of part or all of the molecule onto the surface of polar substrates. A variety of other ingredients may be incorporated into the composition containing the butadiene-nitrile copolymer, provided that neither they nor the amount added change the pressure-activated nature of the adhesive. In other words, additives should provide little or no finger tack and should not adversely affect the cohesive and adhesive strength of the adhesive. Such ingredients include fillers, antioxidants, ultraviolet light stabilizers, colorants, adhesion modifiers, and the The adhesive compositions of the present invention can be readily prepared. A butadiene-acrylonitrile copolymer of this invention can be prepared according to the following procedure: The ingredients for a typical polymerization recipe is shown in Table 1.

TABLE 1

| Ingredient | |
|---|---|
| Butadiene | |
| Acrylonitrile | |
| Water | |
| Emulsifier | |
| Modifier | |
| Electrolytes | |
| Catalyst | |
| Activator | |
| Short-stop | |
| Stabilizer | |
| 1. | The monomers are emulsified in water and agitated at a constant temperature. |
| 2. | A catalyst is added to generate free radicals and initiate polymerization. |
| 3. | When the monomers have copolymerized to the desired degree, a short-stop is added to inactivate the catalyst. |
| 4. | The residual monomers are removed from the emulsion by degassing and vacuum distillation. |
| 5. | A stabilizer, or antioxidant, is added to the latex to protect the polymer during the drying and storage periods. |
| 6. | The latex is coagulated by mixing it with an aqueous solution of an inorganic salt; the polymer agglomerates into small crumbs. |
| 7. | Water soluble materials are removed from the crumbs by washing with water. |

Emulsifiers suitable for the process include rosin acids and derivatives thereof, fatty acids and derivatives thereof, and synthetic detergents. Modifiers suitable for the process include mercaptans and derivatives thereof, aroyl disulfides, aliphatic disulfides, and alkyl sulfonates. Electrolytes suitable for the process include potassium laurate, sodium chloride, and ammonium chloride. Catalysts suitable for the process include heavy metal compounds, such as ferric sulfate, cobaltous chloride. Activators suitable for the process include peroxides without reducing agents, e.g., organic peroxides, hydroperoxides, peroxides with redox activators, e.g., organic peroxides with metal ions, peroxides with amines. Short-stops suitable for the process include sodium-hydrogen sulfite, hydroquinones. Stabilizers suitable for the process include amines, e.g., octylated diphenylamine and phenolics, e.g., tertiary butyl-p-cresol.

The primary reaction is shown schematically below:

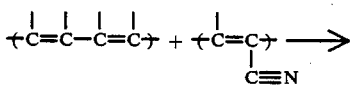

butadiene acrylonitrile

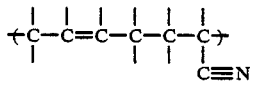

butadiene-acrylonitrile polymer

Other ingredients such as fillers, antioxidants, ultraviolet light stabilizers, colorants, adhesion modifiers and the like may also be added with the butadiene-acrylonitrile copolymer.

The amount of adhesive employed is at least 0.025 g/cm$^2$, and preferably is from 0.05 to 0.75 g/cm$^2$. More than 0.75 g/cm$^2$ may be employed if desired although there is generally no advantage obtained in terms of improved adhesion by so doing.

A variety of techniques may be utilized to apply the adhesive to a substrate. For example, adhesives prepared by solution techniques may be applied to the substrate at room temperature (e.g., 25° C.) by, for example, solvent or extrusion coating, Mayer bar coating, or rotogravure coating techniques. After application of the adhesive, the solvent may be removed by heating the substrate at a temperature, e.g., 65° C., and for a time sufficient to remove the solvent but insufficient to degrade either the adhesive or the substrate. A typical duration is 30 seconds.

Figure 2:
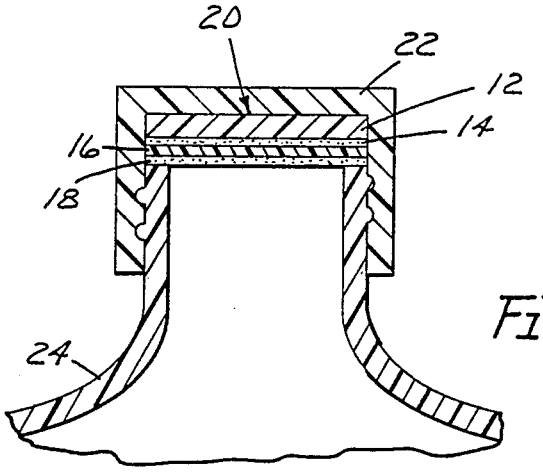
FIG. 2 is a sectional view, in elevation, of a cap and innerseal of this invention sealed to a container.

The resultant sheet may then be cut to any desired shape and applied to a container. Techniques for application to a container are known and will not be described in detail here. Briefly, referring to FIG. 2, they involve placing a section 20 of the sheet material either in a cap 22 to be applied to the container 24 or over the opening of the container so that the adhesive coating is disposed to contact the lip of the container opening. Preferably, the section of innerseal applied is slightly larger in size (e.g., diameter) than the sum of the sizes of the container opening and the lip surrounding it. The cap is then placed over the opening and tightened to the container. While the present invention may be used with equal effectiveness on threaded and non-threaded (e.g., snap fit) closures, it must be remembered that it is necessary to apply pressure to the innerseal in order to activate the adhesive.

If pressure is applied by a twisting force, the amount of torque that must be applied to the innerseal in order to adhere it to the container is somewhat dependent upon the size of the opening to be covered. The following table lists several opening sizes, in terms of the diameter of the caps used to cover the openings, and the representative torque forces which gave excellent adhesion to the innerseal to an unplasticized poly(vinyl chloride) bottle.

| Cap diameter (mm) | Torque (m-kg) |
|---|---|
| 15 | 0.06 (5 in-lbs) |
| 20 | 0.11 (10 in-lbs) |
| 28 | 0.20 (18 in-lbs) |
| 38 | 0.28 (25 in-lbs) |
| 43 | 0.31 (27 in-lbs) |
| 48 | 0.34 (30 in-lbs) |
| 53 | 0.39 (34 in-lbs) |
| 63 | 0.45 (40 in-lbs) |
| 70 | 0.51 (45 in-lbs) |

However, significantly lower torque forces are generally all that is required to provide satisfactory adhesion of the innerseal to the container. For example, a torque force of as low as 0.08 m-kg (7 in-lbs) satisfactorily adheres the innerseal to an unplasticized poly(vinyl chloride) bottle that utilizes a 28 mm diameter The innerseal of the present invention has many advantages over innerseals of the prior art. The major advantages can be summarized as follows:

(1) Because the adhesive of the innerseal is activated by pressure, expensive heating equipment is not required.

(2) Because heating is not required, energy costs of the packager can be reduced.

(3) Because metal foil is no longer needed for conducting heat, the cost of raw materials can be reduced; moreover, cost of waste arising from foil handling problems can be reduced.

(4) Heat activated innerseals tend to at least partially melt the lip of plastic containers in order to provide a good seal. This is undesirable for many specially designed bottle lips, such as the "dripless" feature for containers in the area of liquid products.

(5) Because metal caps shield most of the heat energy applied to induction heat innerseals, metal caps are undesirable for induction heat innerseals. The innerseal of this invention does not have this drawback and allows consistent sealing of metal caps.

The present invention is further described by the following example wherein all amounts are parts by weight unless otherwise specified.

EXAMPLE 1

The following materials in the amounts indicated were used to prepare the adhesive of Example 1.

| Ingredients | Amount (parts by weight) |
|---|---|
| Acrylonitrile | 22 |
| Butadiene | 78 |
| Distilled water | 180 |
| Alkali salt of dehydroabietic acid | 3.6 |
| Tert-dodecyl mercaptan | 0.4 |

-continued

| Ingredients | Amount (parts by weight) |
|---|---|
| Hydrogen peroxide (20%) | 0.4 |
| Iron sulfate heptahydrate | 0.02 |
| Sodium hyposulfite | 1.0 |
| Trinonyl phenyl phosphite | 3.0 |

The distilled water, the alkali salt of dehydroabietic acid, the tert-dodecyl mercaptan, the butadiene, and 12 parts acrylonitrile, were introduced into a clean container.

The resulting emulsion was agitated for about five minutes; then the hydrogen peroxide and iron sulfate heptahydrate were added; the emulsion continued to be agitated while the temperature was held at 7° C. When the level of conversion reached about 35%, the remainder of the acrylonitrile was added to the container.

Polymerization was continued at 7° C. for about 16 hours. At that point, the sodium hyposulfate and trinonyl phenyl phosphite were added to terminate the polymerization.

Alum was added to coagulate the polymerized latex into a crumb form, and the crumb-like material was thoroughly washed with water to eliminate excess precipitated agents, such as emulsifier, modifier, etc. The crumb-like material was then dried. The Mooney viscosity of the copolymer was 130, when measured according to ASTM D1646-87 at 100° C. for 4 minutes. The acrylonitrile content of the copolymer was 25% by weight. The Tg of the copolymer was below −25° C., the vinyl content of the copolymer was below 10% by weight, and there were little or no cross-links in the copolymer.

Table I compares peel adhesion of a sample of the present invention with commercially available heat induction innerseals. The peel adhesion of the innerseal of the present invention significantly exceeds that of the commercially available innerseals.

TABLE I

| Trade Name | Innerseal Induction heat* | Peel adhesion (180°)[1] UPVC | PET | PC | PVDC |
|---|---|---|---|---|---|
| SG-90 | (Minnesota Mining and Manufacturing Co., St. Paul, MN) | 48 | 55 | 20 | 19 |
| SG-18EP | Minnesota Mining and Manufacturing Co., St. Paul, MN) | 114 | 101 | 94 | 98 |
| SG-104 | (Minnesota Mining and Manufacturing Co., St. Paul, MN) | 181 | 190 | 35 | 57 |
| Pressure-activated** | | | | | |
| Example 1 | | 200 | 200 | 163 | 116 |

*Sealed at 40 psi, 350° F. for 5 seconds
**Sealed at 40 psi, 75° F. for 5 minutes
[1]UPVC = unplasticized polyvinyl chloride
PET = polyethylene terephthalate
PC = polycarbonate
PVDC = polyvinylidene dichloride In Table I, the data shows that the innerseal of the present invention provides higher peel adhesion (180°) than do commercially available induction heat innerseals.

Peel adhesion (180°) was determined in the following manner:

1. Polyvinyl chloride (PVC) sheet (6 mil thickness), polyethylene terephthalate (PET) sheet (6 mil thickness), polycarbonate (PC) sheet (6 mil thickness), and polyvinylidene chloride (PVDC) sheet (6 mil thickness) were used as the adherends.

2. The heat sealable surface of a PET film (850 film ICI America, 0.8 mil thickness) was coated with a solution of acrylonitrile-butadiene copolymer (10% solids in toluene) by means of knife coating at a wet coat thickness of 5 mil. The coated PET film was air dried at room temperature for five minutes and then oven dried at 150° F. for one hour to form an innerseal film strip.

3. The PVC sheet, the PET sheet, the PC sheet, and the PVDC sheet were cut into 1 in.×6 in. strips by means of a razor blade, and the innerseal film was cut into a 1 in.×11 in. strip by means of a razor blade.

4. The innerseal film strip was pressed onto each adherend sheet at a pressure of 40 psi for 5 minutes.

5. Peel adhesion was then determined with a TMS Instron apparatus (Instron Corp., Canton, Mass.). The innerseal/adherend samples were clamped with jaws on the crosshead on the Instron apparatus and then peeled at a 180° angle at 12 in./min extension rate. Peel adhesion results were reached on chart paper running at a rate of 5 in./min. Peel adhesion was expressed in ounces.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A pressure-activated innerseal comprising a substrate bearing on at least one major surface thereof a layer of an adhesive composition comprising an amorphous butadiene-nitrile random copolymer having a single glass transition temperature no higher than about −25° C., a nitrile content no higher than about 31% by weight, a Mooney viscosity of at least 95 (measured according to ASTM D1646-87 at 100° C. for 4 minutes), a vinyl content of no greater than 10% by weight, said composition being substantially free of cross-links, provided that said composition is free of any additive that provides more than little or no finger tack.

2. The innerseal of claim 1, wherein the nitrile content is from about 18% by weight to about 30% by weight.

3. The innerseal of claim 1, wherein the Mooney viscosity is from about 120 to about 150.

4. The innerseal of claim 1, wherein the nitrile moiety is acrylonitrile.

5. The innerseal of claim 1, wherein the nitrile moiety is methacrylonitrile.

6. A container comprising the innerseal of claim 1, wherein the portion of the container in contact with the innerseal is formed from a material having high polarity.

7. The container of claim 6, wherein said high polarity material is a polymeric material.

8. The container of claim 7, wherein said polymeric material is selected from the group consisting of polyvinyl chloride, polyester, polycarbonate, polyvinylidene chloride, polystyrene, nitrile rubber, and derivatives of nitrile rubber.

9. A pressure-activated innerseal comprising from top to bottom:

(a) a first film made of paper or polymeric material;

(b) a layer of adhesive formed from thermoplastic or thermosetting plastic or rubber;

(c) a second film made of paper or polymeric material; and (d) a layer of an adhesive composition comprising an amorphous butadiene-nitrile random copolymer having a single glass transition temperature no higher than about −25° C., a nitrile content no higher than about 31% by weight, a Mooney viscosity of at least 95 (measured according to ASTM D1646-87 at 100° C. for 4 minutes), a vinyl content of no greater than 10% by weight, said composition being substantially free of cross-links, provided that said composition is free of any additive that provides more than little or no finger tack.

10. The innerseal of claim 9, wherein the adhesive of layer (b) is a pressure-sensitive adhesive.

11. The innerseal of claim 9, wherein the nitrile content is from about 18% by weight to about 30% by weight.

12. The innerseal of claim 9, wherein the Mooney viscosity is from about 120 to about 150.

13. The innerseal of claim 9, wherein the nitrile moiety is acrylonitrile.

14. The innerseal of claim 9, wherein the nitrile moiety is methacrylonitrile.

15. A container comprising the innerseal of claim 9, wherein the portion of the container in contact with the innerseal is formed from a material having high polarity.

16. The container of claim 15, wherein said high polarity material is a polymeric material.

17. The container of claim 16, wherein said polymeric material is selected from the group consisting of polyvinyl chloride, polyester, polycarbonate, polyvinylidene chloride, polystyrene, nitrile rubber, and derivatives of nitrile rubber.

* * * * *